US010981182B2

(12) United States Patent
Hornek et al.

(10) Patent No.: US 10,981,182 B2
(45) Date of Patent: Apr. 20, 2021

(54) CENTRIFUGE WITH COOLING SYSTEM IN CENTRIFUGE HOUSING

(71) Applicant: ANDREAS HETTICH GMBH & CO. KG, Tuttlingen (DE)

(72) Inventors: Matthias Hornek, Tuttlingen (DE); Klaus-Guenter Eberle, Tuttlingen (DE)

(73) Assignee: ANDREAS HETTICH GMBH & CO. KG, Tuttlingen (DE)

( * ) Notice: Subject to any disclaimer, the term of this patent is extended or adjusted under 35 U.S.C. 154(b) by 1056 days.

(21) Appl. No.: 15/326,470

(22) PCT Filed: Jul. 24, 2015

(86) PCT No.: PCT/EP2015/067015
§ 371 (c)(1),
(2) Date: Jan. 14, 2017

(87) PCT Pub. No.: WO2016/012596
PCT Pub. Date: Jan. 28, 2016

(65) Prior Publication Data

US 2017/0209874 A1 Jul. 27, 2017

(30) Foreign Application Priority Data

Jul. 24, 2014 (DE) ..... 102014110467.6

(51) Int. Cl.
*B04B 15/02* (2006.01)
*B04B 7/02* (2006.01)
*B04B 7/06* (2006.01)

(52) U.S. Cl.
CPC ..... *B04B 15/02* (2013.01); *B04B 7/02* (2013.01); *B04B 7/06* (2013.01)

(58) Field of Classification Search
CPC ..... B04B 15/02; B04B 7/02; B04B 7/06
(Continued)

(56) References Cited

U.S. PATENT DOCUMENTS 4,053,104 A * 10/1977 Penhasi ..... B01L 7/00 494/14
4,941,866 A * 7/1990 Gorodissky ..... B04B 15/02 494/14
(Continued)

FOREIGN PATENT DOCUMENTS

DE 884475 7/1953
DE 3031423 2/1982
(Continued)

OTHER PUBLICATIONS

Becken, K et al. Fluorierte Treibhausgase Vermeiden, Wege Zum Ausstieg, Umweltbundesamt, 2010, pp. 1-304.
(Continued)

*Primary Examiner* — Charles Cooley
(74) *Attorney, Agent, or Firm* — Woodling, Krost and Rust

(57) ABSTRACT

A centrifuge (10) having a centrifuge housing, a safety vessel (14) arranged in the centrifuge housing, an interior space (16) at least partially bounded by the safety vessel (14), a rotor arranged in the interior space (16), and a cooling system, arranged in the centrifuge housing, for cooling the interior space (16), having a compressor (22), a condenser (24) and an evaporator (26), which are connected together via lines. The invention is distinguished by the fact that the cooling system has a primary circuit (52) with primary line (29) and a secondary circuit (62) with secondary line (34), wherein the primary circuit (52) comprises the compressor (22), the condenser (24) and the evaporator (26), which is part of a heat exchanger (30), and wherein the secondary circuit (62) flows through the heat exchanger (30), cools the safety vessel (14) and is provided with a pump (32).

10 Claims, 4 Drawing Sheets

(58) Field of Classification Search
USPC ..... 494/14
See application file for complete search history.

(56) References Cited

U.S. PATENT DOCUMENTS

| | | | | | |
|---|---|---|---|---|---|
| 5,477,704 | A | | 12/1995 | Wright | |
| 5,538,492 | A | * | 7/1996 | Potter | B04B 7/06 494/12 |
| 6,866,621 | B1 | * | 3/2005 | Muller | B04B 15/02 494/14 |
| 7,794,383 | B2 | * | 9/2010 | Tetsu | B04B 5/0442 494/7 |
| 10,471,441 | B2 | * | 11/2019 | Eberle | B04B 7/06 |
| 10,894,260 | B2 | * | 1/2021 | Eberle | B04B 7/02 |
| 2011/0160030 | A1 | * | 6/2011 | Heilmann | B04B 15/02 494/14 |
| 2014/0349827 | A1 | * | 11/2014 | Janzen | B04B 7/02 494/14 |
| 2015/0080202 | A1 | * | 3/2015 | Mueller | F25B 49/022 494/7 |
| 2017/0209874 | A1 | * | 7/2017 | Hornek | B04B 15/02 |
| 2021/0001352 | A1 | * | 1/2021 | Muller | B04B 7/06 |

FOREIGN PATENT DOCUMENTS

| | | | | | |
|---|---|---|---|---|---|
| DE | 102005026128 | | 1/2006 | | |
| DE | 102010050894 | | 5/2012 | | |
| DE | 202013004850 | | 7/2013 | | |
| DE | 102012002593 | | 8/2013 | | |
| GB | 1018285 | | 1/1966 | | |
| JP | 07144155 | A * | 6/1995 | | B04B 15/02 |
| JP | H07144155 | | 6/1995 | | |
| JP | 2005230744 | | 9/2005 | | |
| JP | 2010274230 | | 12/2010 | | |

OTHER PUBLICATIONS

European Patent Office, International Search Report and Written Opinion, dated Oct. 26, 2015, pp. 1-11, International Application No. PCT/EP2015/067015, Applicant: Andreas Hettich GmbH.

German Patent and Trademark Office, Search Report, dated Apr. 29, 2015, pp. 1-10, Application No. 102014110467.6, Applicant: Andreas Hettich GmbH & Co. KG.

German Patent and Trademark Office, Examination Report, dated May 10, 2016, pp. 1-2, Application No. 102014110467.6, Applicant: Andreas Hettich GmbH & Co. KG.

European Patent Office, International Preliminary Report on Patentability, dated Feb. 2, 2017, pp. 1-17, International Application No. PCT/EP2015/067015, Applicant: Andreas Hettich GmbH & Co. KG.

* cited by examiner

CENTRIFUGE WITH COOLING SYSTEM IN CENTRIFUGE HOUSING

PCT/EP2015/067015, international application filing date Jul. 24, 2015 and German patent application no. 10 2014 110 467.6, filed Jul. 24, 2014 are incorporated herein by reference hereto in their entireties. Benefit of, and priority of, German patent application no. 10 2014 110 467.6 is claimed.

FIELD OF THE INVENTION

The invention relates to a centrifuge.

DESCRIPTION OF THE RELATED ART

Undesired heat is generated during the operation of a centrifuge, which heat has a damaging effect on the material to be centrifuged. What is especially problematic here is that, for safety reasons, the centrifuge rotor whose rotation and the resulting atmospheric friction generates most of the heat is usually arranged within a safety vessel firmly sealed by a lid—which makes it difficult for the heat to escape. Often, biological samples require a temperature of 4° C. which needs to be maintained during centrifugation. Active cooling is therefore indispensable, especially for longer operating times, high rotational speeds, and sample temperatures below ambient temperature.

Various generic centrifuges are known in the prior art which include a compression refrigeration unit. A refrigerant flows within a cooling circuit which is divided into a high-pressure area and a low-pressure area by a throttle and a compressor. After heat is extracted from the refrigerant in a condenser in the high-pressure area, it then flows to the low-pressure area where it passes through lines arranged in spirals, for example, around a safety vessel which accommodates the centrifuge rotor, thus extracting heat from the safety vessel.

While this type of refrigeration has been tried and tested and is reliable, it also has some shortcomings. For example, owing to the high kinetic energy occurring during operation, high safety standards need to be observed in particular for centrifuges. Flammable refrigerants ensure a high degree of efficiency of the refrigeration system. However, owing to the danger of a rotor crash and consequent rupturing of the safety vessel wall which may also cause sparking, safety concerns prohibit the use of flammable refrigerants in centrifuges. In their stead, fluorinated refrigerants, so-called F gases, are usually used because they are not flammable. However, these F gases have a high greenhouse potential, for which reason their use is more and more restricted and/or prohibited by the law.

SUMMARY OF THE INVENTION

It is the object of the present invention to provide a centrifuge which does not have the above mentioned shortcomings and which can be cooled efficiently and which is unproblematic both from a safety point of view and as far as the environment is concerned.

The invention is based on the finding that subdividing the cooling circuit into two separate areas, a safety-critical one and a non-safety-critical one separated from the former, this object can be accomplished in a simple manner, and in particular when a different heat transfer medium—refrigerant—is used in each area.

According to the invention, the centrifuge has a centrifuge housing, a safety vessel arranged in the centrifuge housing, an interior space bounded by the safety vessel, a rotor arranged in the interior space, and a cooling system, arranged in the centrifuge housing, for cooling the interior space. The cooling system has a compressor, a condenser and an evaporator, which are connected together via line means. It is considered particularly advantageous for the cooling system to have a primary circuit with primary line means and a secondary circuit with secondary line means, wherein the primary circuit comprises the compressor, the condenser and the evaporator, which is part of a heat exchanger, and wherein the secondary circuit flows through the heat exchanger and cools the safety vessel. In order to safeguard a constant flow of the heat transfer medium and thus efficient cooling of the safety vessel, a pump is provided in the secondary circuit.

This allows the use of a different heat transfer medium in each circuit, depending on the safety requirements, which in turn provides additional design options with regard to taking specific safety measures for the respective circuit.

More specifically, in the primary circuit, a conventional flammable refrigerant can flow which is comparatively inexpensive and has a high specific evaporation enthalpy.

However, with regard to the danger of a rotor crash and consequent rupturing the safety vessel, it is advantageous to use a non-flammable heat transfer medium in the secondary circuit. The use of cooling water with additives which lower the freezing point, for example salt or alcohol, is inexpensive and friendly to the environment.

In one aspect of the present invention, the primary circuit is arranged underneath the secondary circuit and the safety vessel. This considerably reduces the risk of the primary circuit being damaged as a result of a rotor crash and consequent rupturing of the rotor vessel.

However, if the primary circuit is mounted laterally offset relative to the secondary circuit in the centrifuge housing, a clearly more compact centrifuge design can be achieved, especially concerning its vertical expansion.

In an advantageous further development of the invention, a safety wall is provided between the primary circuit and the secondary circuit so as to spatially separate the two circuits. This further diminishes the risk of damage to the primary circuit in the event of a rotor crash and consequent rupturing of the safety vessel, when the primary circuit is mounted laterally offset relative to the secondary circuit.

It is considered advantageous to secure the safety vessel in the centrifuge housing by means of a clamping connection which will allow relative movement of the safety vessel with respect to the centrifuge housing in the event of a rotor crash. In the event of a crash, a movement, in particular a rotary movement, of the safety vessel will be initiated by the rotor or rotor parts crashing into the safety vessel and the resulting angular momentum, which movement will be decelerated by the clamping connection. The energy of the crash acting on the centrifuge housing will thus be clearly reduced or completely eliminated, which results in improved protection of the primary circuit from damage.

In another aspect of the invention, at least one additional mass element is provided for stabilizing the centrifuge housing. This stabilization also serves to protect the primary circuit from the impact of the angular momentum resulting from a rotor crash.

Furthermore, protection of the primary circuit can be improved by making the primary line means from a material that is mechanically stronger than that of the secondary line means.

In an alternative embodiment, the secondary line means have predetermined breaking points. In the case of a particularly vast momentum caused by a rotor crash and which cannot be compensated sufficiently by a relative movement of the safety vessel with respect to the centrifuge housing, the mechanical connection between the secondary circuit and the primary circuit will be separated, thus preventing the momentum from reaching the area of the primary circuit via the secondary line means and inflicting damage there.

Preferably, the safety vessel is surrounded by a separate protective wall which is more specifically of cylindrical shape and extends concentrically relative to the safety vessel. This further diminishes the risk of damage to the primary circuit or to the centrifuge housing in the event of a rotor crash.

Furthermore, it is advantageous for the above mentioned predetermined breaking points to be provided in those places where the secondary line means extend through the cylindrical protection wall. In this arrangement, in the event of a movement, in particular a rotary movement, of the safety vessel relative to the centrifuge housing, the secondary line means will be slightly sheared off by the protective wall.

A predetermined breaking point may be formed in the secondary line means, as explained above, for example by weakening a segment of the line means. As an alternative to forming a predetermined breaking point in the line means, the predetermined breaking point can also be formed solely by assigning a shearing device to one segment of the line means. The shearing device will be activated in the case of a relative movement, in particular a rotary movement, of the safety vessel in that the line means will be moved towards the shearing device and/or the shearing device will be moved towards the line means. In this process, the shearing device will then sever the line means in the assigned segment. This solution requires little design effort and has the advantage, amongst others, that lower-cost line means can be used in the secondary circuit since it will no longer be necessary to provide weakened segments in the line means. This also makes the installation of the line means easier, since the position of the predetermined breaking point is determined by the arrangement of the shearing device and not by a particular segment of the line means.

In yet another preferred embodiment, dampening and/or insulating material is provided in the primary circuit, in particular between the compressor, the condenser and the evaporator. Dampening material provides more stability, above all when a major momentum acts on the primary circuit from the exterior. In particular, this prevents the compressor, which is supported on elastic dampening elements, from being torn out of its mounts and pipelines from rupturing. As a further positive characteristic, insulating material increases the efficiency of the cooling components. For example, molded parts made from hard foam are very well suited for fulfilling these two tasks and serving as dampening and insulating material. It is particularly advantageous here if the molded parts are provided with integrated ducts which can on the one hand be used for running cables, and on the other hand for a defined airflow.

A positive side effect of this invention is that the demands made on the line means provided in the secondary circuit are still clearly lower than the demands made on the line means provided in the low-pressure area of a conventional refrigeration device with one cooling circuit. Because firstly, the operating pressure in the secondary circuit of a refrigeration device of the present invention is still considerably lower than the operating pressure in the low-pressure area of a conventional refrigeration device. Secondly, owing to the separation of the two circuits, any damage to the line means in the secondary circuit will not result in any safety risks. Consequently, instead of rigid, massive and costly line means such as copper pipes, flexible tubes can be used here. This reduces the design effort and diminishes the costs of the centrifuge.

Additional advantages, features and possible applications of the present invention may be gathered from the description which follows, in which reference is made to the embodiments illustrated in the drawings.

BRIEF DESCRIPTION OF THE DRAWINGS

Throughout the description, the claims and the drawings, those terms and associated reference signs are used as are indicated in the list of reference signs which follows below. In the drawings.

DESCRIPTION OF THE INVENTION

Figure 1:
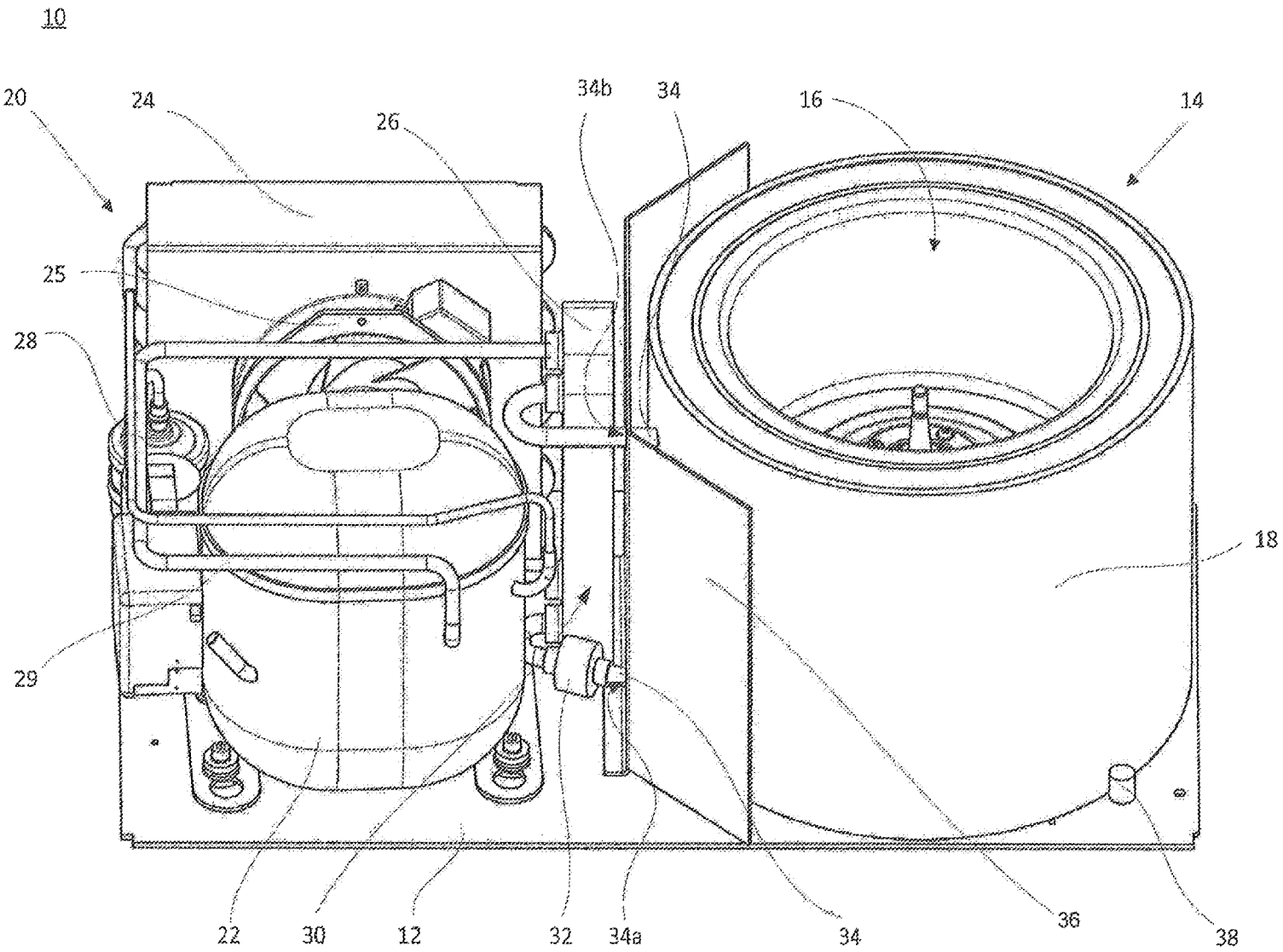
FIG. 1 is a schematic perspective view of a centrifuge according to the invention.

FIG. 1 is a schematic perspective view of a centrifuge 10 according to the present invention. For the sake of clarity, the housing is not shown in this drawing; the arrangement of the housing cover 13*a* and the side walls 13*b* may be gathered from FIG. 3. A safety vessel 14 of the centrifuge 10 is mounted on a base plate 12 together with a compression refrigeration unit 20. The compression refrigeration unit 20 essentially comprises a compressor 22, a condenser 24, a ventilator 25, a filter dryer 28 and an evaporator 26 that is part of a heat exchanger 30, which components are connected together via primary pipes 29 to thus form a sealed primary circuit 52 (see FIG. 2). A flammable refrigerant 54 flows in the primary pipes 29.

Figure 2:
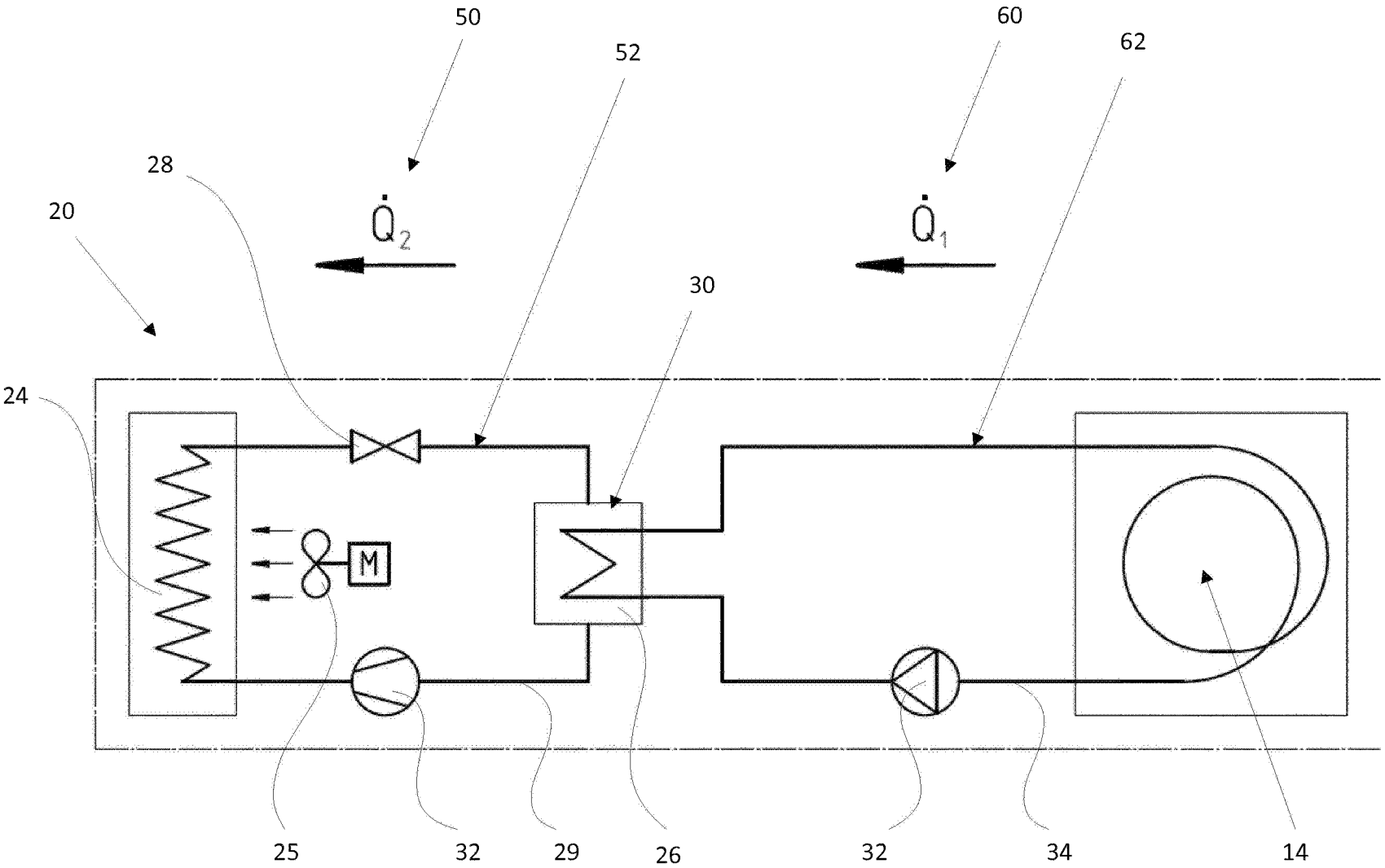
FIG. 2 is a schematic graph of the two cooling circuits.

The safety vessel 14 is surrounded by secondary pipes 34 which are only shown to some extent in this drawing and which essentially form a sealed secondary circuit 62 (see FIG. 2). A non-flammable heat transfer medium 64 flows in the secondary pipes 34.

The structure of the primary circuit 52 and the secondary circuit 62 is also illustrated more clearly in the schematic view of FIG. 2.

A protective cylinder 18 runs concentrically around the safety vessel 14 and is more specifically horizontally secured by four clamping elements 38 which are mounted at regular intervals from each other on the base plate 12, along the outer circumference of the protective cylinder 18. However, this perspective view only shows one clamping element 38. In the event of a rotor crash, the protective cylinder 18 will prevent flying rotor parts from being scattered further, which may rupture and penetrate the centrifuge wall and thus inflict major damage there. For additional protection of the primary circuit 52 from penetrating rotor parts in the event of a crash, which may even rupture the protective cylinder 18, a safety wall 36 is mounted on the base plate 12 between the safety vessel 14 and the compression refrigeration unit 20.

The secondary circuit 62 runs through the heat exchanger 30. For this purpose, two openings 34*a* and 34*b* are provided in the safety wall 36, with pipes 34 of the secondary circuit 62 extending through each of said openings 34*a*, 34*b*. The pipe 34 runs from the safety vessel 14 through the opening 34*b* to the heat exchanger 30 in which heat is withdrawn from the secondary circuit 62. Mounted between the heat exchanger 30 and the opening 34*a*, through which the pipe 34 runs back to the safety vessel 14, is a pump 32 for circulating the non-flammable heat transfer medium 64.

FIG. 2 is a schematic view of the principle of the two-circuit cooling of a centrifuge 10 according to the invention. On a cold side 60, there is the secondary circuit 62 in which a non-flammable heat transfer medium 64 circulates. The heat transfer medium 64 is circulated in secondary pipes 34 around a safety vessel 14, thus withdrawing heat from said safety vessel 14. Furthermore, a pump 32 is provided which circulates the heat transfer medium 64.

On the warm side 50, there is the primary circuit 52 in which a flammable refrigerant 54 flows, with the compression refrigeration unit 20 that comprises the compressor 22, the condenser 24, the ventilator 25, the throttle 28 and the evaporator 26, which components are connected together by primary pipes 29.

The evaporator 26 is part of a heat exchanger 30 which also has pipes 34 of the secondary circuit 62 running through it. Consequently, the primary circuit 52 and the secondary circuit 62 are thermally coupled via the heat exchanger 30. In the heat exchanger 30, the non-flammable heat transfer medium 64 from the secondary circuit 62 transfers the heat withdrawn from the safety vessel 14 to the flammable refrigerant 54 in the primary circuit 52. Via the condenser 24, the flammable refrigerant 54 transfers the heat thus transferred to the ambient air 56. The heat delivery is improved by the use of the ventilator 25. Compression refrigeration units are essentially well known so that no further explanations are necessary here.

Figure 3:
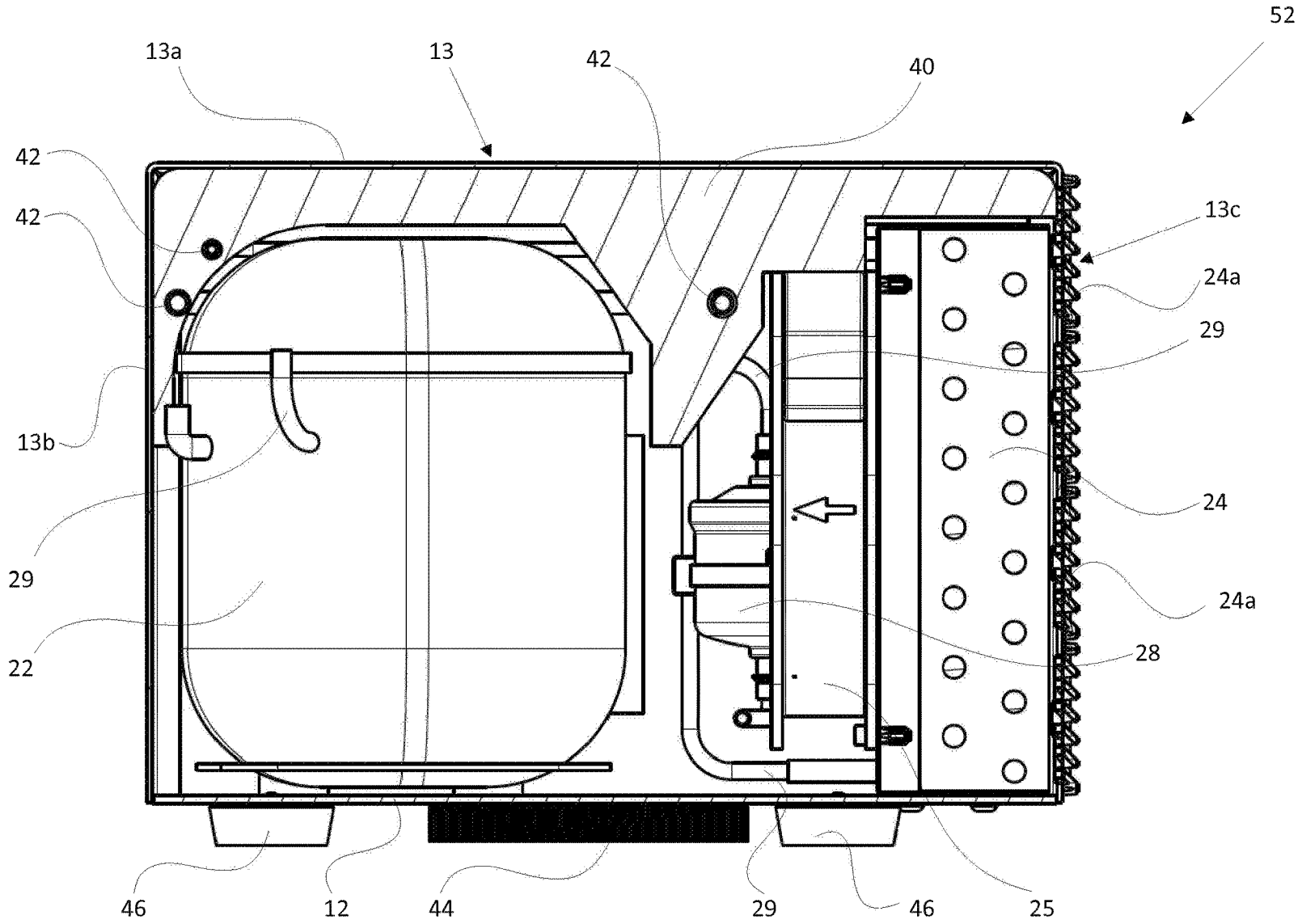
FIG. 3 is a lateral sectional view of the primary circuit of a centrifuge according to the present invention with dampening and insulation elements.

FIG. 3 is a lateral, partially sectional view of the primary circuit 52 of the centrifuge 10 from the perspective of the secondary circuit 62. As already described with reference to FIG. 1, the compressor 22, the condenser 24 with associated ventilator 25, the filter dryer 28 and the evaporator 26 (not shown here) are connected to each other via primary pipes 29. The primary circuit 52, similar to the secondary circuit 62 not shown in FIG. 3, is surrounded by a rectangular housing 13 which has a base plate 12 at its bottom, a housing cover 13 at its top, and sidewalls 13*b*, 13*c* between the base plate 12 and the housing cover 13*a*. Ventilation slots 24*a* are provided in the area of sidewall 13*c* adjacent to the condenser 24.

In the space between the housing 13 and the components of the primary circuit 52 with the largest spatial expansion, i.e. in particular compressor 22, condenser 24, ventilator 25 and evaporator 26 (not shown here), a molding 40 made from rigid foam is provided for insulation and for the purpose of dampening vibrations. The shape of the hard-foam molding 40 is adapted to the housing 13 and—in some parts—to the profile of the above-mentioned components of the primary circuit 52. The hard-foam molding 40 extends horizontally between the sidewalls 13*b* and 13*c* along the housing cover 13*a*, and vertically—in some parts—along the sidewalls 13*b* and 13*c*, as well as—in some parts—along the profile of the above mentioned components of the primary circuit 52. The vertical expansion of the hard-foam molding 40 is adapted to the structural conditions of the primary circuit and chosen such that it can be fitted in easily, surrounds about the upper third of the compressor 22, and at the same time abuts on the top of the aforementioned components of the primary circuit 52. The compressor 22 for example surrounds the hard-foam molding 40 approximately in the upper third of its vertical expansion. Furthermore, ducts 42 are provided in the hard-foam molding 40 in which primary pipes 29 run.

The centrifuge 10 is supported on four feet 46 mounted on the bottom side of the base plate 12 on a surface, with two of said feet 46 being below the primary circuit. For increased stability, a rectangular mass element 44 is also mounted on the bottom side of the base plate 12, roughly at its center.

Figure 4:
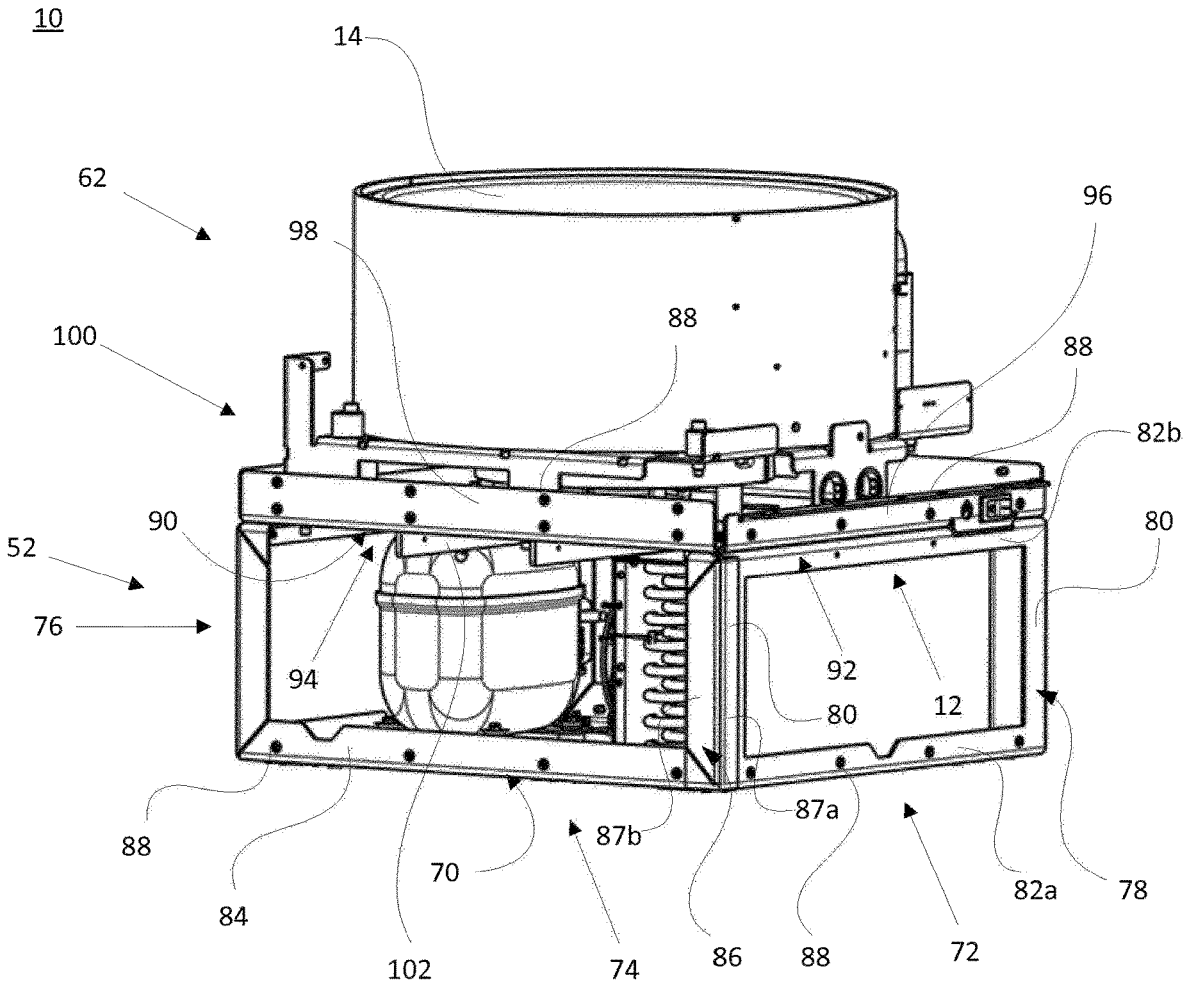
FIG. 4 is a schematic perspective view of a centrifuge according to the present invention which has a primary circuit arranged underneath the secondary circuit.

FIG. 4 is a view of an alternative embodiment of a centrifuge 10 according to the invention, in which a secondary circuit 62 is arranged above a primary circuit 52. For the sake of clarity, no housing is shown in this drawing.

The primary circuit 52 is mounted on a rectangular base plate 70 having two front sides 72 and two longitudinal sides 74. Its structure and function are identical to that of the primary circuit 52 shown in FIG. 1 to 3, so no further explanations are necessary here. Attached to the edges of the base plate 70 by means of screws 88 is a frame 76 which on the one hand serves to mount sidewalls of the housing (not shown here) and on the other hand to stably secure an intermediate base 90 having two front sides 92 and two longitudinal sides 94, on which the secondary circuit 62 is mounted. The frame 76 comprises two rectangular frame parts 78 each having two front sides 80 and two longitudinal sides 82*a* and 82*b* which are arranged between the two front sides 72 of the base plate 70 and the two front sides 92 of the intermediate base 90. The longitudinal sides 82*a* are firmly connected to the base plate 70 by means of screws 88, and the longitudinal sides 82*b* are firmly connected to the intermediate base 90 by means of screws 88. The frame 76 furthermore comprises two horizontally extending frame elements 84 which are each firmly connected to the base plate 70 at their two longitudinal sides 74 by means of screws 88, as well as four vertical frame elements 86. The vertically extending frame elements 86 extend from the four corners of the base plate 70 to the four corners of the intermediate base 90. For improved stability, the frame elements 86 have two legs 87*a* and 87*b* which are perpendicular to each other and which are formed integrally with each other and made of the same material. The legs 87*a* are each arranged between the front side 72 of the base plate 70 and the front side 92 of the intermediate base 90, and the legs 87*b* are each arranged between the longitudinal side 74 of the base plate 70 and the longitudinal side 94 of the intermediate base 90. Attached to both front sides 92 of the intermediate base 90—amongst other things for attaching sidewalls of the housing not shown here—are horizontal frame elements 96 and attached to both longitudinal sides 94 are horizontal frame elements 98, by means of screws 88.

As far as structure and function are concerned, the secondary circuit 62 which is arranged on the intermediate base 90 essentially corresponds to the one described with reference to FIG. 1 to 3, for which reason no further explanations are necessary here. Merely the arrangement of the secondary pipes 34 relative to each other has been suitably modified, owing to the vertical arrangement of the primary circuit 52 above the secondary circuit 62. The safety vessel 14 and the protective cylinder 18 surrounding it are supported on a holding device 100 which is firmly connected to the intermediate base 90 and the horizontal frame elements 98 as well as the horizontal frame elements 96. For additional stabilization, supporting struts 102 are provided underneath the intermediate base 90 which extend in parallel to the front sides 92 and are firmly secured to the intermediate base 90 and the horizontal frame elements 98 by means of screws 88.

LIST OF REFERENCE SIGNS

10 centrifuge
12 baseplate
13 housing
13*a* housing cover
13*b*, 13*c* sidewalls
14 safety vessel
16 interior space
18 protective cylinder
20 compression refrigeration unit
22 compressor
24 condenser
25 ventilator
26 evaporator
28 filter dryer
29 primary pipes
30 heat exchanger
32 pump
34 secondary pipes
34*a* opening
34*b* opening
36 safety wall
38 clamping elements
40 hard-foam molding
42 ducts
44 mass element
50 warm side
52 primary circuit
54 flammable refrigerant
56 ambient air
60 cold side
62 secondary circuit
64 non-flammable heat transfer medium
70 base plate
72 front sides
74 longitudinal sides
76 frame
78 frame parts
80 front sides
82*a*, 82*b* longitudinal sides
84 horizontally extending frame element
86 vertically extending frame element
88 screws
90 intermediate base
92 front sides
94 longitudinal sides
96 horizontal frame elements
98 horizontal frame elements
100 holding device
102 support struts
$Q_1$ cold side heat flow
$Q_2$ warm side heat flow

What is claimed is:

1. A centrifuge (10), comprising:
a centrifuge housing (13):
a safety vessel (14) arranged in a protective cylinder (18) in said centrifuge housing (13):
an interior space (16) partially bounded by said safety vessel (14);
a rotor arranged in said interior space (16);
a cooling system arranged in said centrifuge housing (13) for cooling said interior space (16);
said cooling system has a compressor (22), a condenser (24) and an evaporator (26) which are connected together via lines;
said cooling system has a sealed primary circuit (52) with primary lines (29) and a sealed secondary circuit (62) with secondary lines (34);
a flammable refrigerant (54) in said sealed primary circuit (52);
a non-flammable refrigerant (64) in said sealed secondary circuit (62);
said sealed primary circuit (52) comprises said compressor (22), said condenser (24) and said evaporator (26), said evaporator is part of a closed heat exchanger (30); and,
said sealed secondary circuit (62) passes through said closed heat exchanger (30), cools said safety vessel (14) and is provided with a pump (32).

2. The centrifuge as claimed in claim 1, further comprising:
said primary circuit (52) is arranged underneath said secondary circuit (62) and said safety vessel (14).

3. The centrifuge as claimed in claim 1, further comprising:
said primary circuit (52) is mounted in said centrifuge housing (13) so as to be laterally offset relative to said secondary circuit (62).

4. The centrifuge as claimed in claim 3, further comprising:
a safety wall (36) is mounted between said primary circuit (52) and said safety vessel (14) to spatially separate these components.

5. The centrifuge as claimed in claim 1, further comprising:
at least one additional mass element (44) is provided in said centrifuge housing (13) for stabilizing said centrifuge housing (13).

6. The centrifuge as claimed in claim 1, further comprising:
said primary lines (29) are made of a material which is mechanically stronger than the material of said secondary lines (34).

7. The centrifuge as claimed in claim 6, further comprising:
predetermined breaking points are provided in said secondary lines (34).

8. The centrifuge as claimed in claim 1, further comprising:
said safety vessel (14) is surrounded by said protective cylinder (18) which is separate from said safety vessel (14).

9. The centrifuge as claimed in claim 1, further comprising:
dampening and/or insulation material (40) is provided in said primary circuit (52) between said compressor (22), said condenser (24) and said evaporator (26).

10. A centrifuge (10), comprising:
a centrifuge housing (13);
a safety vessel (14) arranged in a separate protective cylinder (18) in said centrifuge housing (13);
an interior space (16) partially bounded by said safety vessel (14);
a rotor arranged in said Interior space (16);
a cooling system arranged in said centrifuge housing (13) for cooling said interior space (16);
said cooling system has a compressor (22), a condenser (24) and an evaporator (26) which are connected together via lines;

said cooling system has a sealed primary circuit (52) with primary lines (29) and a sealed secondary circuit (62) with secondary lines (34);

a flammable refrigerant (54) in said sealed primary circuit (52);

a non-flammable refrigerant (64) in said sealed secondary circuit (62);

said safety vessel is surrounded by said separate protective cylinder (18) which runs concentrically around said safety vessel (14);

clamping connections (38) horizontality secure said separate protective cylinder (18) to said centrifuge housing;

said clamping connections (38) which in the event of a rotor crash will enable said safety vessel (14) to move relative to said centrifuge housing (13);

said sealed primary circuit (52) comprises said compressor (22), said condenser (24) and said evaporator (26), said evaporator is part of a closed heat exchanger (30); and, said sealed secondary circuit (62) passes through said closed heat exchanger (30), cools said safety vessel (14) and is provided with a pump (32).

* * * * *